US010767500B2

(12) United States Patent
Kobayashi

(10) Patent No.: US 10,767,500 B2
(45) Date of Patent: Sep. 8, 2020

(54) FAN BLADE PITCH SETTING

(71) Applicant: GE Aviation Systems, LLC, Grand Rapids, MI (US)

(72) Inventor: Sukeyuki Kobayashi, Loves Park, IL (US)

(73) Assignee: GE AVIATION SYSTEMS, LLC, Grand Rapids, MI (US)

( * ) Notice: Subject to any disclaimer, the term of this patent is extended or adjusted under 35 U.S.C. 154(b) by 503 days.

(21) Appl. No.: 15/148,782

(22) Filed: May 6, 2016

(65) Prior Publication Data

US 2017/0321561 A1 Nov. 9, 2017

(51) Int. Cl.

| | |
|---|---|
| ***F04D 29/34*** | (2006.01) |
| ***F01D 7/00*** | (2006.01) |
| ***F04D 29/36*** | (2006.01) |
| *F01D 5/30* | (2006.01) |

(52) U.S. Cl.

CPC ..... *F01D 7/00* (2013.01); *F04D 29/34* (2013.01); *F04D 29/36* (2013.01); *F01D 5/3069* (2013.01)

(58) Field of Classification Search

CPC .... F01D 5/3007; F01D 5/3023; F01D 25/005; F04D 29/287; F04D 29/34; F04D 29/36

See application file for complete search history.

(56) References Cited

U.S. PATENT DOCUMENTS

| | | | | |
|---|---|---|---|---|
| 4,419,052 | A * | 12/1983 | Stamm | F01D 5/30 416/214 A |
| 4,605,355 | A | 8/1986 | Davis et al. | |
| 5,211,924 | A * | 5/1993 | Lee | B01F 7/16 366/279 |
| 5,520,515 | A | 5/1996 | Bailey et al. | |
| 6,139,277 | A * | 10/2000 | Lopatinsky | F01D 5/3015 416/220 A |
| 6,592,328 | B1 | 7/2003 | Cahill | |
| 6,692,233 | B2 * | 2/2004 | Liang | F04D 25/088 403/325 |
| 8,794,914 | B2 * | 8/2014 | Hommes | F04D 29/023 415/206 |

* cited by examiner

*Primary Examiner* — Woody A Lee, Jr.
*Assistant Examiner* — Michael L Sehn
(74) *Attorney, Agent, or Firm* — General Electric; Cynthia Parks

(57) ABSTRACT

There are provided techniques and apparatuses for fan blade pitch setting. For example, there is provided an impeller including a ring disposed in a hub of the impeller. The ring can include a recess shaped and positioned to impart a specified pitch angle to a blade extending outwardly from the ring through the hub.

14 Claims, 8 Drawing Sheets

FAN BLADE PITCH SETTING

I. TECHNICAL FIELD

The present invention relates generally to impellers. In particular, the present invention relates to approaches for optimizing the design and manufacture of fan impellers.

II. BACKGROUND

Impellers are fundamental to the operation of centrifugal pumps, turbines, and other fan-based applications. Impellers are typically used as a means of transmitting motion. In aerospace applications, for example, impellers can provide avionics cooling, cabin recirculation, and oil cooling, etc. When developing or manufacturing a new fan/impeller, fine-tuning of design is often needed, to meet a given airflow requirement. This process can be very time-consuming. Consequently, impellers often require longer lead times than other components during the manufacturing process.

Impellers for aerospace applications are typically formed of a single piece of cast metal. Additionally or alternatively, impellers can also be machine-cut from a billet. Often, when developing a new fan or impeller, multiple design iterations are used to test and verify that the fan/impeller meets a given airflow requirement. The design iterations typically include iterations of the impeller's blade setting angle (i.e., its pitch angle). As such, for a single-piece impeller, design iterations require re-making the entire impeller, and the manufacturing processes required to produce these conventional components can be costly and time intensive.

By way of example, the conventional manufacture of cast metal impellers is heavily dependent upon the manufacturing foundry's internal schedule. More than 20 weeks of lead time is not uncommon. In fact, one iteration of a single design can require more than 40 weeks altogether.

III. SUMMARY

The embodiments featured herein help mitigate the above-noted deficiencies as well as other issues known in the art.

In contrast to conventional impellers constructed of a single piece of material, the embodiments provide a modular impeller formed of several components. For example, one embodiment provides an impeller including a ring disposed in a hub of the impeller. The ring includes a recess shaped and positioned to impart a specified pitch angle to a blade extending outwardly from the ring through the hub.

Another embodiment provides an impeller including a blade having a portion shaped to mate with a recess of a ring disposed in a hub of the impeller. The recess provides a specified pitch angle for the blade.

Yet another embodiment provides an impeller assembly including a plurality of blades, a hub, and a pitch-setting ring disposed on an inner wall of the hub. The pitch-setting ring includes a plurality of recesses, where each recess is configured to mate with a portion of one blade to provide a specified pitch angle for the one blade.

Additional features, modes of operations, advantages, and other aspects of various embodiments are described below with reference to the accompanying drawings. It is noted that the present disclosure is not limited to the specific embodiments described herein. These embodiments are presented for illustrative purposes. Additional embodiments, or modifications of the embodiments disclosed, will be readily apparent to persons skilled in the relevant art(s) based on the teachings provided.

IV. BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are for purposes of illustrating the embodiments and are not to be construed as limiting the disclosure. Given the following enabling description of the drawings, the novel aspects of the present disclosure should become evident to a person of ordinary skill in the relevant art(s).

V. DETAILED DESCRIPTION

Figure 1:
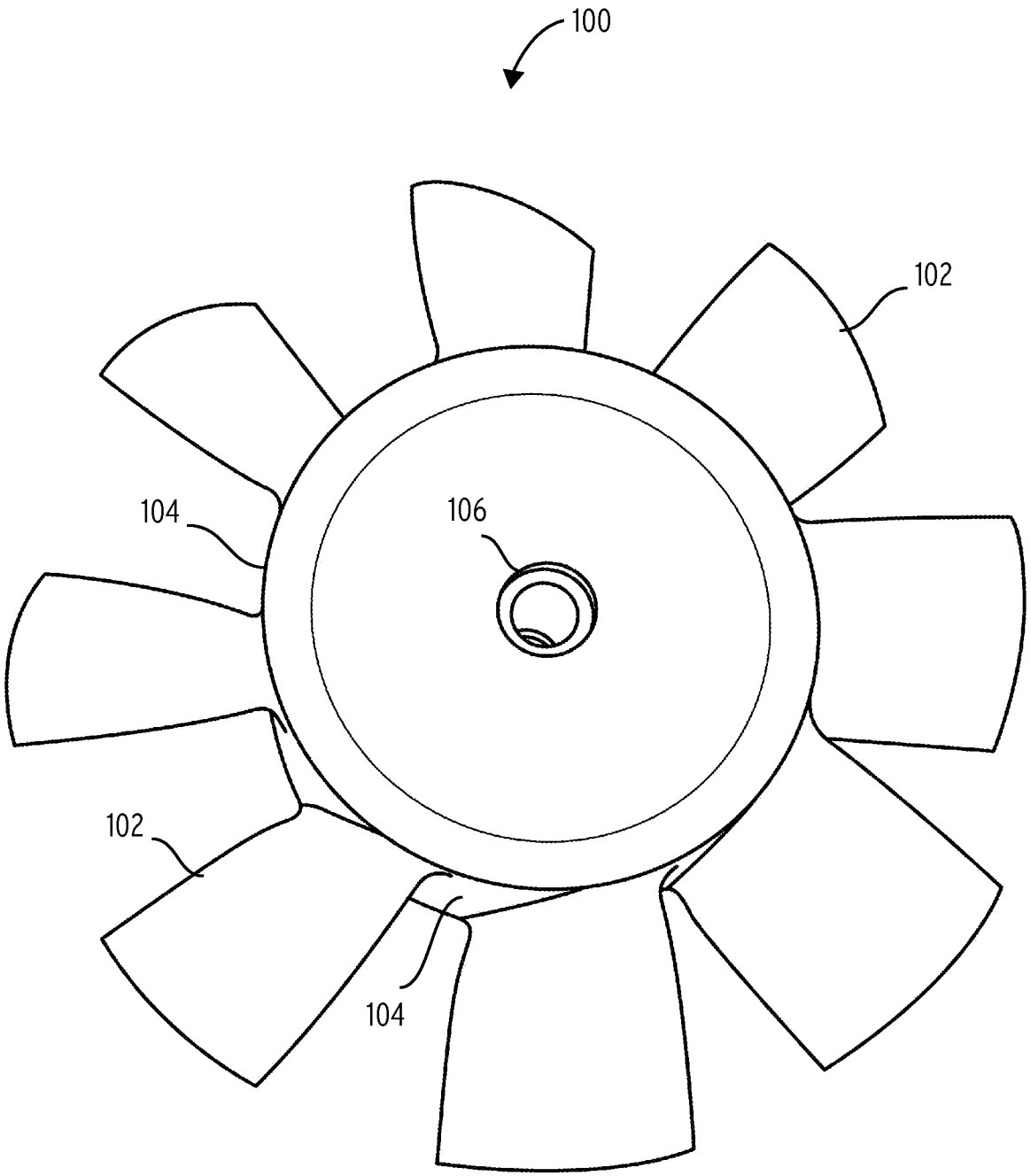
FIG. 1 illustrates an example of a conventional impeller.

FIG. 1 illustrates an example of a conventional impeller 100. The conventional impeller 100 includes a set of blades 102 extending from a hub 104, and a shaft bore 106 that is either machined, formed or otherwise fashioned in the center of hub 104. The shaft bore 106 receives a shaft (not shown) around which the conventional impeller 100 can rotate. The conventional impeller 100 can be made from a single piece of material that can include an aluminum alloy. For instance, the aluminum alloy can be cast in a mold to make the conventional impeller 100, and trimmed by a milling machine, with the shaft bore 106 being formed therein.

Tuning, adjusting or otherwise changing several parameters of the conventional impeller 100 will affect its air flow performance. For example, adjusting the pitch angle of the set of blades 102 can change the air flow performance of the conventional impeller 100. Therefore, for a specified set of air flow requirements, the conventional impeller 100 has to be manufactured with the set of blades 102 having a specific pitch angle that meets the air flow requirements.

However, when the air flow requirements change, another conventional impeller having dimensions that meet the new requirements must be manufactured. Another conventional impeller is needed because the conventional impeller 100 is a single-piece component, and the pitch angle of its set of blades 102 cannot be independently altered. Therefore, because a new impeller is needed every time air flow requirements change, there can be significant delays and increased costs associated with maintenance of systems that utilize the conventional impeller 100.

The embodiments described below solve the aforementioned issues by providing a modular assembly of a fan or impeller. The embodiments include a set of modular and detachable blades as well as a pitch-setting ring configured for insertion into a hub of the impeller. The pitch-setting ring includes a set of recesses shaped and positioned to impart a specified pitch angle to each blade. Specifically, the ring can be fitted with individual blades, and the recesses are angled in a manner to provide a specified pitch angle. The sub-assembly of the ring with the blades can be inserted in the hub and secured on an inner wall of the hub, thereby yielding the modular fan/impeller assembly.

As such, when air flow requirements change, in the embodiments, the blades and the hub do not need to be remade. Instead, only the ring is remade with new recesses that provide a different pitch angle, and the hub and the blades can be reused. That is, impellers with different pitch angles can be constructed at reduced costs and faster lead times. The embodiments thus provide significant savings in lead time, materials, inventory control, and overall cost.

Figure 2:
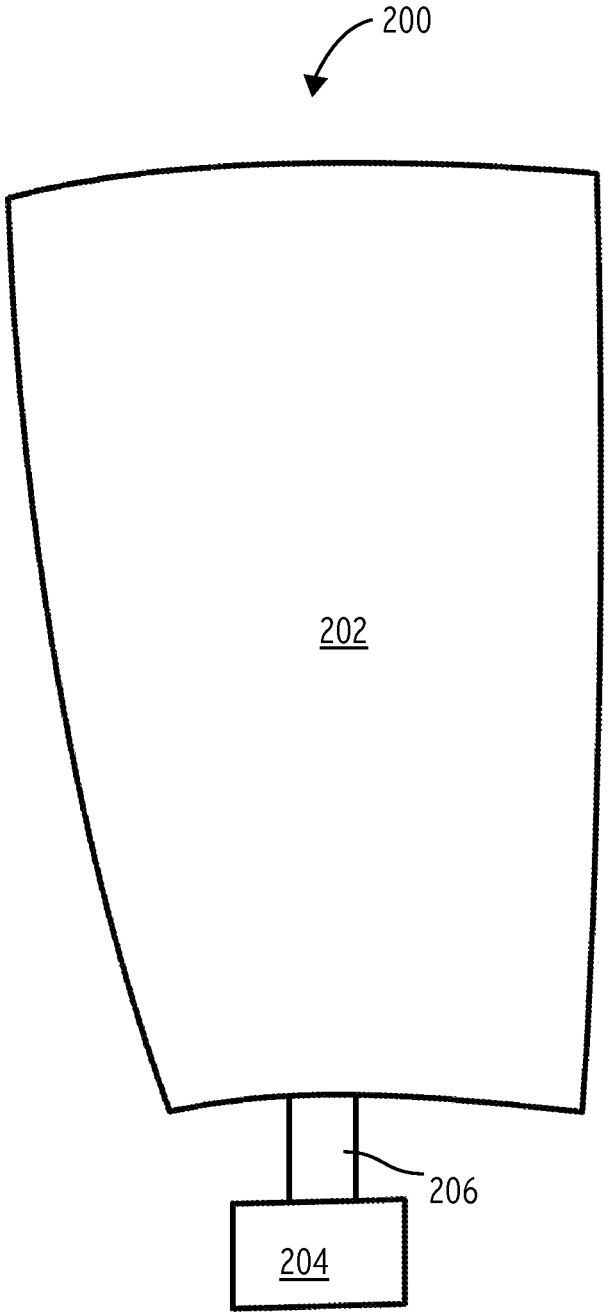
FIG. 2 illustrates an example blade in accordance with various aspects described herein.
Figure 3:
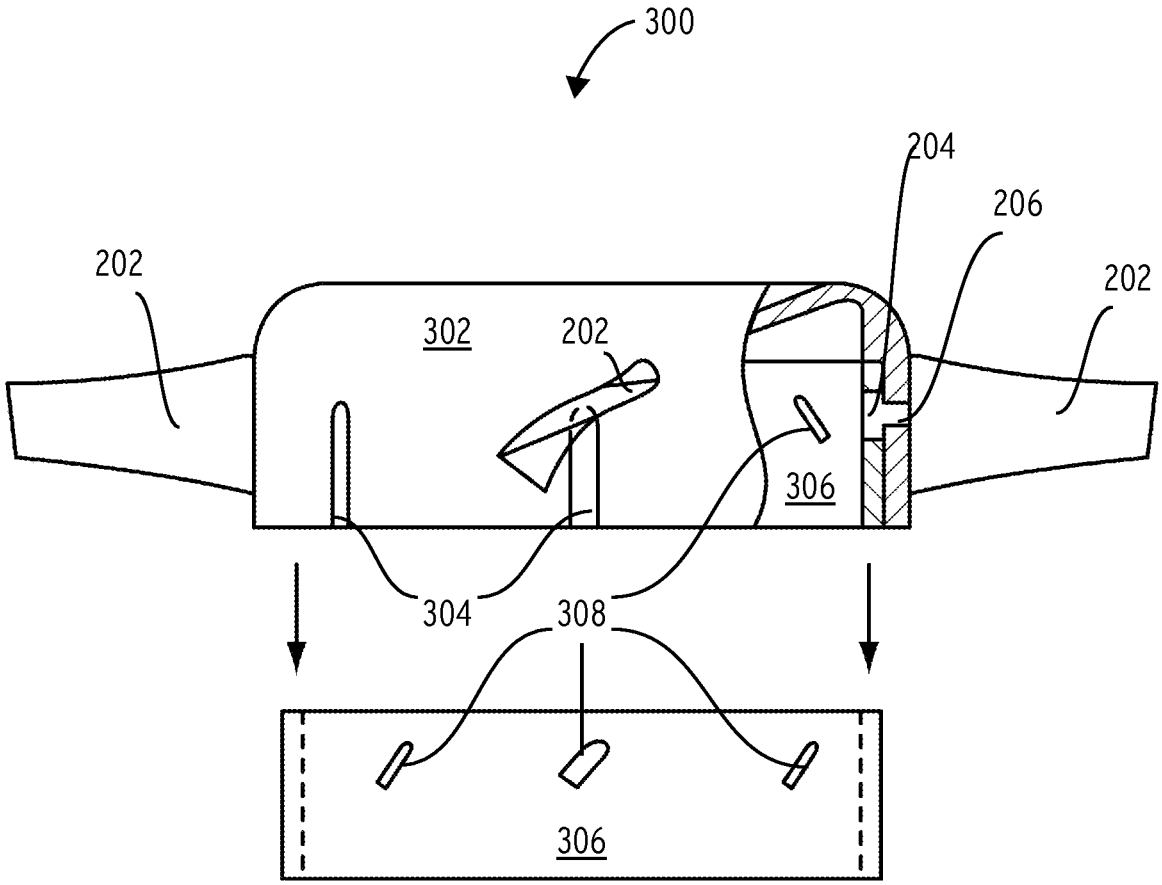
FIG. 3 illustrates an example cross-sectional view of an impeller in accordance with various aspects described herein.

Unlike the conventional impeller 100, which is made with a single piece of material, the embodiments disclosed herein are modular and they include several components. For example, they include a set of blades (of which one is illustrated in FIG. 2), and they include a hub and a pitch setting ring (which are illustrated in FIG. 3). Specifically, FIG. 2 illustrates an exemplary blade 200 that includes a first portion 202 and a second portion 204 that are joined by a rod 206. The first portion 202, i.e. the main section of the blade 200, is configured to create a particular airflow pattern around it. The second portion 204 (i.e., tongue of the blade 200) and the rod 206 are dimensioned so as to interface with a hub 302 through a slot included in the body of the hub 302 (see FIG. 3).

A set of blades 200 can be mounted on and secured on an exemplary impeller 300, as shown in FIG. 3. Specifically, the set of blades 200 are mounted on the body of the hub 302, with each blade 200 having its first portion 202 extending outwardly from the body of the hub 302. Furthermore, in impeller 300, the second portion 204 of the blade 200 engages with a recess from a set of a recesses 308 located in a pitch-setting ring 306, and the rod 206 is sized appropriately to fit through a slot from a set of slots 304 in order to allow the first portion 202 of the blade 200 to extend outwardly from the body of the hub 302.

The pitch setting ring 306 can be secured on the inner sidewall of the hub 302 using any appropriate fastener or fastening means. For example, pins or screws, or a combination thereof, can be used to attach the ring 306 to the inner wall of the hub 302. Moreover, the set of slots 304 and the set of recesses 308 can be spaced equidistantly and respectively around the periphery of the hub 302 and the periphery of the pitch-setting ring 306. Additionally or alternatively, however, any spacing can be employed, as long as a slot 304 is positioned in front of a recess 308 to allow a blade 200 to be secured onto the pitch-setting ring 306 secured on the inner sidewall of the hub 302.

Furthermore, a recess 308 can be angled with respect to a vertical axis (e.g. with respect to one of the dashed lines in FIG. 3) in a manner to provide a specified pitch angle to a blade 200 when the second portion 204 of the blade 200 is inserted into the recess 308. For example, the recess 308 can be angled to provide a pitch angle of about 50 degrees when the second portion 204 of the blade 200 is inserted therein. Once assembled in impeller 300, if another pitch angle is desired, the pitch-setting ring 306 can dismounted from the inner sidewall of the hub 302 and removed. A new ring can be made with recesses angled differently, thus providing a different pitch angle than the one achieved with the pitch setting ring 306. As such, this modular impeller structure provides ease of manufacturing iteration for the impeller 300, because only the pitch-setting-ring 306 to be remade, and the hub 302 and the set of blades 200 can be reused.

In one embodiment, all the recesses 308 of the pitch-setting ring 306 can be angled to provide the same pitch angle to each blade 200. In other embodiments, however, at least two recesses 308 can be angled differently to provide a different pitch angle from one blade 200 to the next. In these latter embodiments, such an impeller can be used for reducing the noise created by impeller when it is rotating.

Figure 4:
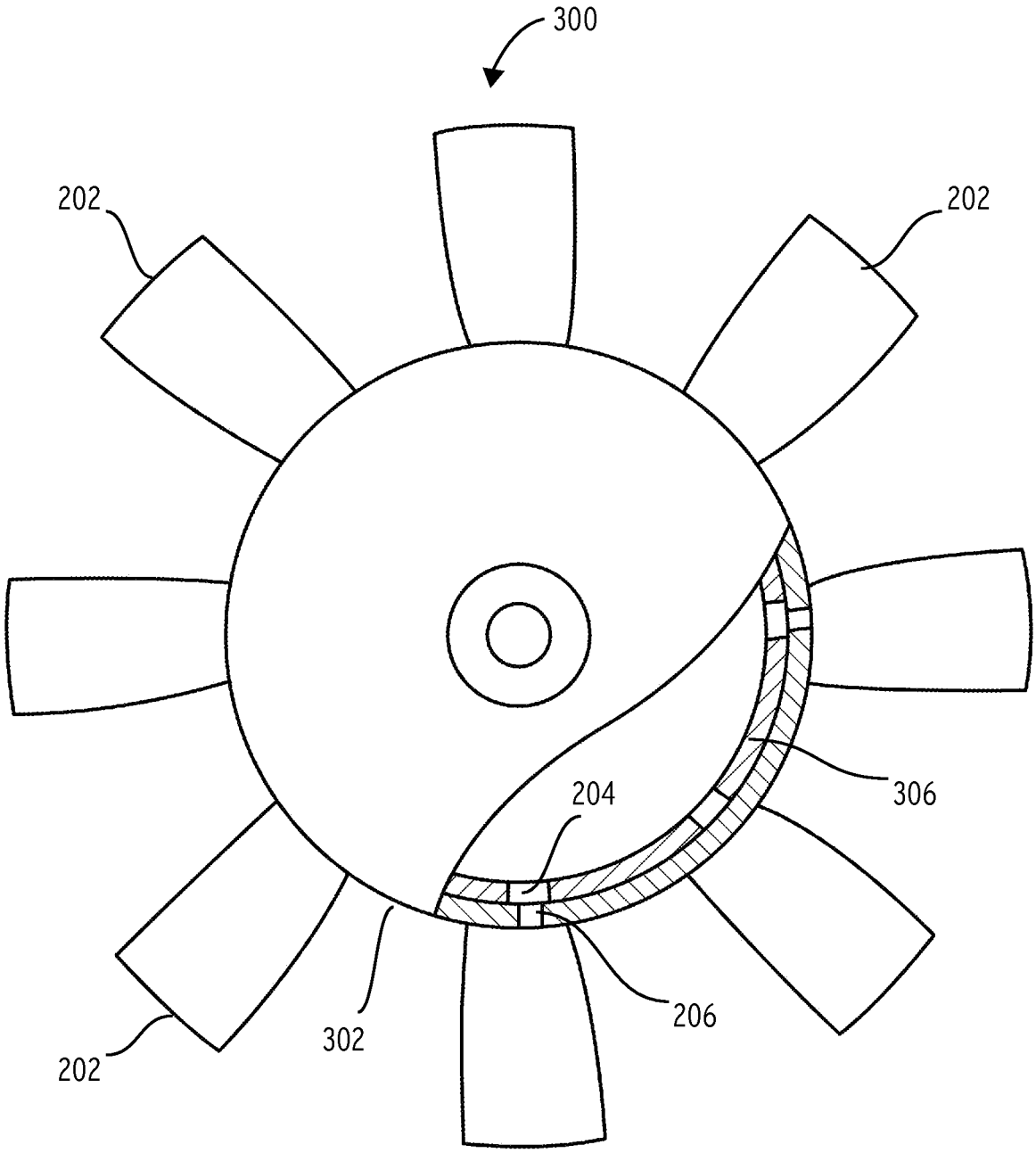
FIG. 4 illustrates an example alternative cross-sectional view of an impeller in accordance with various aspects described herein.

FIG. 4 illustrates an example alternative cross-sectional view of the impeller 300 in accordance with various aspects described herein. As previously discussed, the impeller 300 includes a set of blades 200 whose first portions 202 extend outwardly from the body of the hub 302. The pitch-setting ring 306 is disposed on inside the hub 302 and secured on its inner sidewall. The recesses 308 (not shown in FIG. 4) are shaped and disposed around the pitch-setting ring to confer a specified pitch angle to each one of the plurality of blades 200. A blade 200 can be affixed to a particular recess 308 of the pitch-setting ring 306 by inserting its first portion 204 of into the particular recess 308 and through the slot 304 overlapping the particular recess 308.

Figure 5:
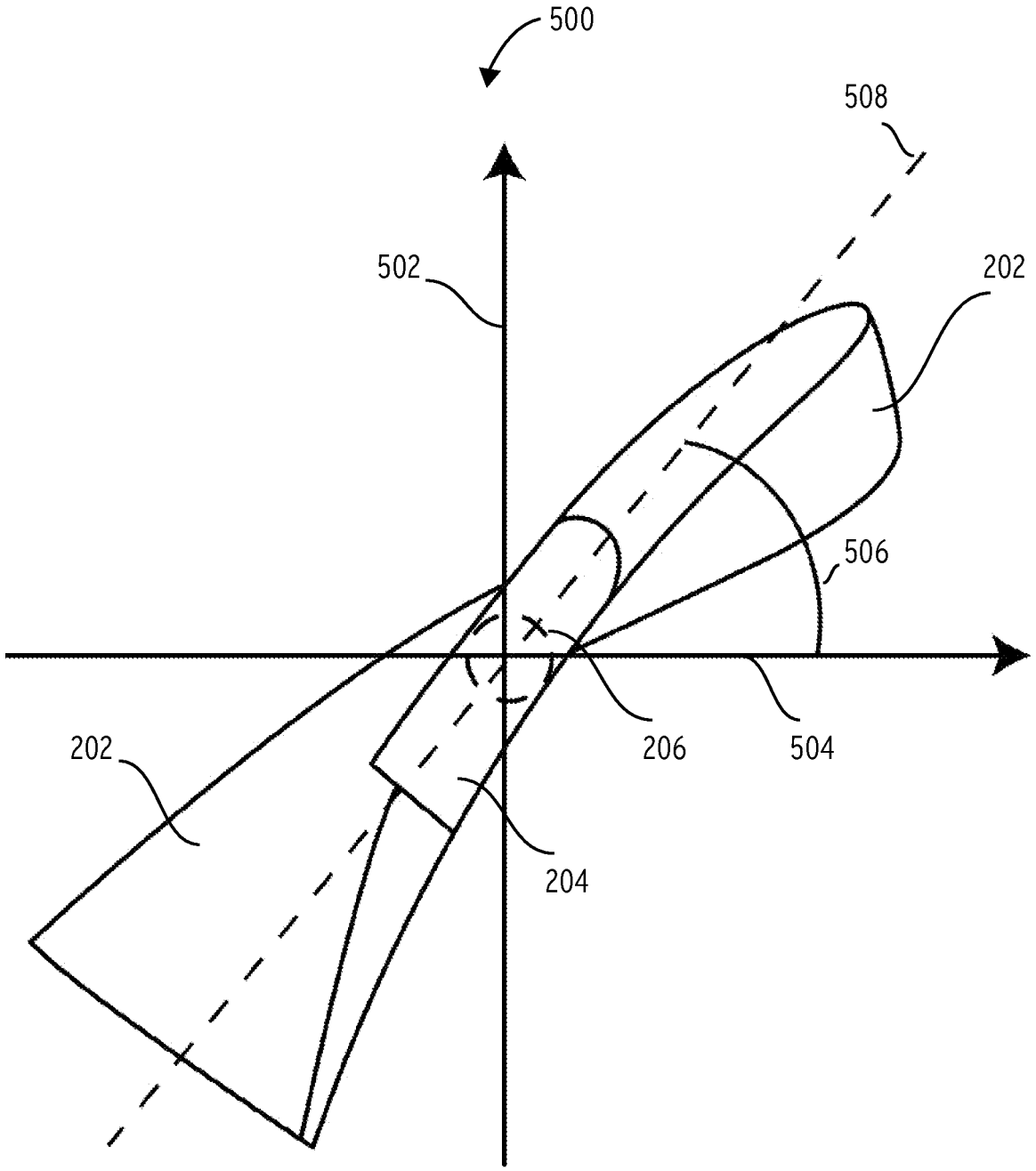
FIG. 5 illustrates an example alternative view of the blade in accordance with various aspects described herein.

FIG. 5 illustrates an example alternative view 500 of the blade 200, when mounted on the impeller 300, as discussed above with respect to FIG. 3 and FIG. 4. For ease of description, the blade 200 is shown together with a frame of reference given by a y-axis 502 and an x-axis 504.

FIG. 5 illustrates a pitch angle 506 imparted to the blade 200 by a recess 308 (not shown in FIG. 5) of pitch-setting ring 306 (not shown in FIG. 5). The recess 308 is formed in the pitch-setting ring at an inclination given by line 508. The impeller 300 can be reconfigured by changing the pitch angle 506. To do so, one can construct a new pitch-setting that has a recess having a different inclination of line 508 than the inclination depicted in FIG. 5.

Figure 6:
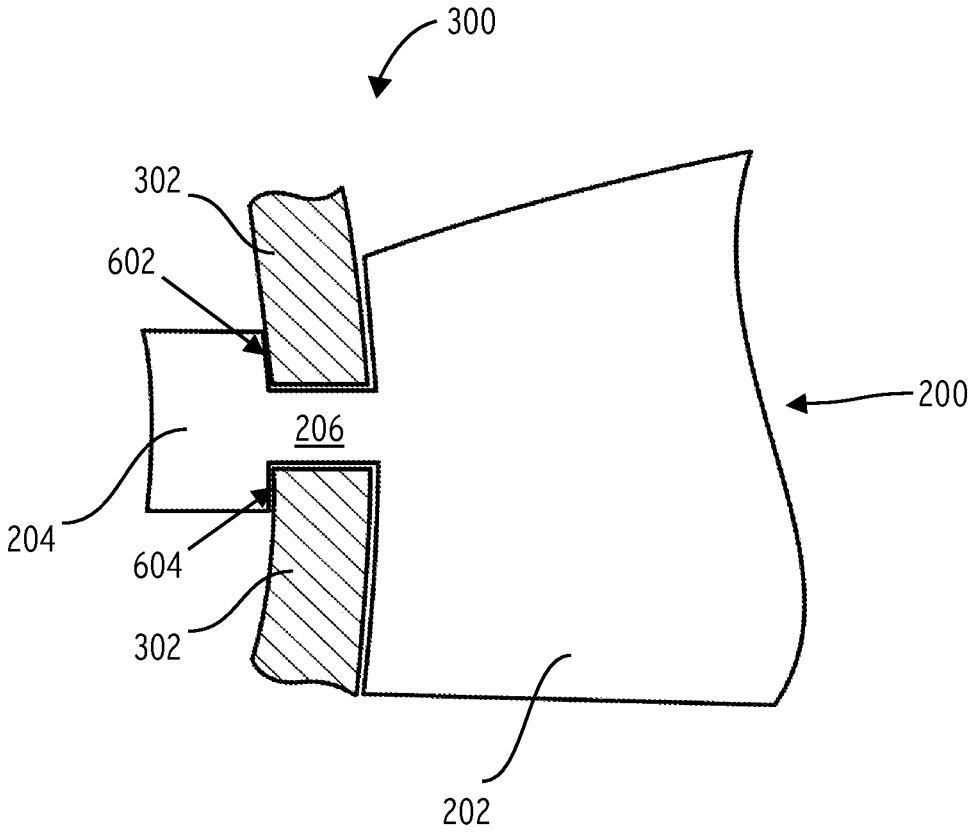
FIG. 6 illustrates an example impeller in accordance with various aspects described herein.

FIG. 6 is an illustration of a part of an impeller 300 according to various aspects described herein. As previously discussed, the impeller 300 includes a blade 200 mounted on the hub 302. For ease of description, the pitch-setting ring 306 holding the blade 200 at the desired pitch angle is not shown.

During operation, an interface between the hub 302 and the blade 200 experiences a compressive stress. For example, when the impeller 300 is rotating, the surface 602 or the surface 604 may experience the compressive stress. Specifically, centrifugal forces created during rotation will translate into compressive stresses on the surfaces 602 and 604.

As an example, in one implementation, the hub 302 and the blades 200 of the impeller 300 can be made of a cast aluminum alloy. Furthermore, the hub 302 can have a nominal diameter of 13 inches (in.) (i.e. twice the distance from the center of the hub 302 to a tip of the blade 200), and the diameter of the hub 302 can be nominally 6.5 in. In this example, the tongue surface area mating the inner wall (e.g. surface 602) is nominally 0.4 $in^2$. Thus, at 8,000 revolutions per minute (rpm), the compressive stress exerted on surface 602 would be about 1,800 pounds per square inch (psi). As such, the compressive stresses exerted on the interface can be far below the yield strength of the cast aluminum alloy, which is typically about 30,000 psi. Under these conditions, material failures would not be expected to ensure based on the compressive stresses exerted on the interface.

Figure 7:
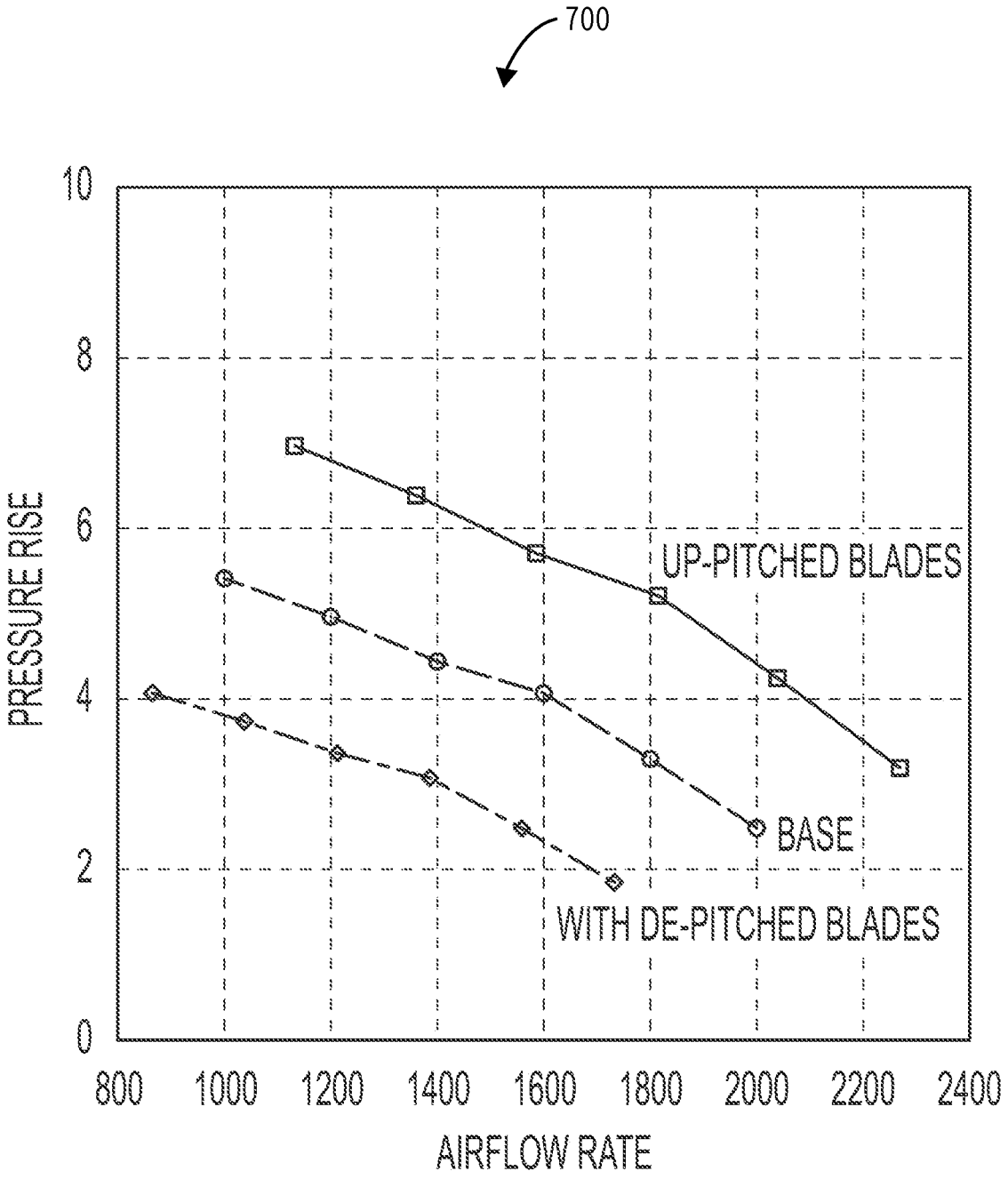
FIG. 7 illustrates an example blade performance graph in accordance with various aspects described herein.

FIG. 7 is a graph 700 plotting pressure rise against air flow rate for three different exemplary impellers. (The units are omitted for the sake of clarity.) All three impellers have the same hub and the same blades, but they each have a different pitch-setting ring, i.e. different pitch angles. Specifically, the first impeller includes a first pitch-setting ring whose recesses impart a first pitch angle to the blade, thus yielding a first performance curve labeled BASE. The second impeller uses a second pitch-setting ring to impart a second pitch angle to the blades, which yields a second performance curve labeled UP-PITCHED BLADES. Lastly, the third impeller uses a third pitch-setting ring to impart a third pitch angle to the blades, thus yielding a third performance curve labeled WITH DE-PITCHED BLADES.

As evidenced by graph 700, the embodiments allow great flexibility in varying pitch angles by using different pitch-setting rings. As such, when impeller 300 is deployed in the field, if the pitch angle of its blades have to be changed because of new air flow performance requirements, its pitch-setting ring 306 can be removed and replaced with a new pitch-setting ring that meets the new requirements. Specifically, the removed pitch-setting ring can be replaced with another ring having recesses inclined to provide the pitch angle that meets the new requirements. Furthermore, the graph 700 shows that a large area of the flow-pressure domain can be covered with a single hub, as opposed to the conventional case, where operation is constrained to a single performance curve since the blades and the hub of the conventional impeller 100 makes one piece and are not modular.

Figure 8:
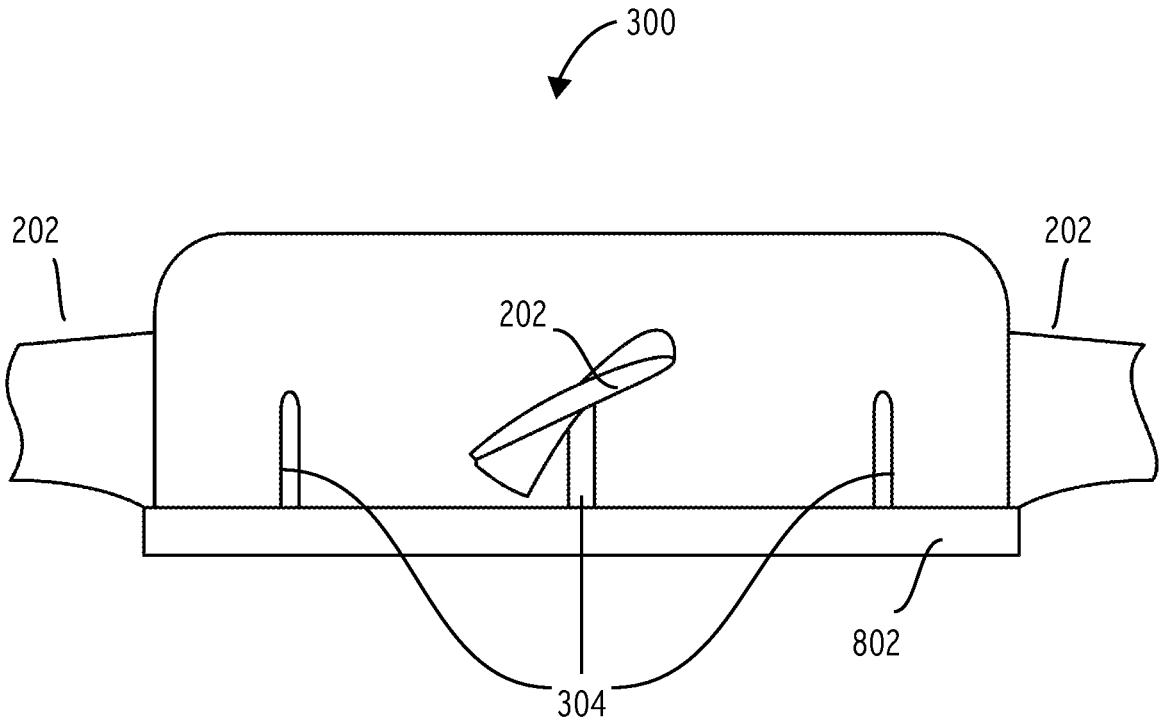
FIG. 8 illustrates an example impeller in accordance with various aspects described herein.

FIG. 8 illustrates an embodiment where impeller 300 is fitted with a reinforcement ring 802 that optionally can be mounted on an outside wall of the hub 302. The hub reinforcement ring 802 can prevent the hub 302 from expanding excessively during operation, when the impeller 100 is operated in high rpm regimes. The hub reinforcement ring 802 can be mounted on the outside wall of the hub using any suitable fastener, such as screws, pins, and the like.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. An impeller comprising:

a ring disposed in a hub of the impeller, wherein the hub has a slot formed through a wall of the hub such that the slot has an open end at one edge of the wall and is configured to receive a portion of a blade through the open end, the ring including a non-circular recess shaped and positioned to impart a specified pitch angle to the blade extending outwardly from the ring through the slot of the hub, the non-circular recess being elongated in a direction different from the slot and non-parallel to a vertical axis where the vertical axis is parallel to an axis of rotation of the impeller;

wherein the blade includes a first portion and a second portion joined by a rod, the second portion engaging the recess to position the blade at the specified pitch angle.

2. The impeller of claim 1, wherein the ring is secured to the hub by a fastener.

3. The impeller of claim 1, further comprising a hub reinforcement ring disposed on an outside wall of the hub.

4. The impeller of claim 1, wherein the hub and the blade are each made of a same material.

5. The impeller of claim 1, wherein the hub is made of an aluminum alloy.

6. The impeller of claim 1, wherein the specified pitch angle is about 50 degrees.

7. An impeller comprising:

a blade including a portion shaped to mate with a recess of a ring disposed in a hub of the impeller, the recess being elongated in a direction different from the slot and non-parallel to a vertical axis to provide a specified pitch angle for the blade, the vertical axis being parallel to an axis of rotation of the impeller, and the hub has a slot formed through a wall of the hub such that the slot has an open end at one edge of the wall and is configured to receive a portion of the blade through the open end.

8. The impeller of claim 7, wherein the blade is made of a same material as that of the hub.

9. An impeller assembly, comprising:

a set of blades;

a hub that has a set of slots formed through one wall of the hub such that each slot has an open end at one edge of the wall and is configured to receive a portion of a blade from a set of blades through the open end; and a pitch-setting ring disposed on an inner wall of the hub, the pitch-setting ring including a set of recesses, wherein each of the recesses is fully enclosed and elongated in a direction non-parallel to a vertical axis and configured to secure the blade from the set of blades at a specified pitch angle and such that the blade is positioned such that it extends through a slot wherein the vertical axis is parallel to an axis of rotation of the impeller.

10. The impeller assembly of claim 9, wherein the pitch-setting ring is fastened on the hub by screws or pins.

11. The impeller assembly of claim 9, wherein a first blade and a second blade included in the set of blades have different pitch angles.

12. The impeller assembly of claim 9, wherein blades from at least one subset of the set of blades have a same pitch angle.

13. The impeller assembly of claim 9, further comprising a hub reinforcement ring disposed on an outside wall of the hub.

14. The impeller assembly of claim 9, wherein the specified pitch angle is about 50 degrees.

* * * * *